US007580656B2

(12) United States Patent
Tanaka

(10) Patent No.: US 7,580,656 B2
(45) Date of Patent: Aug. 25, 2009

(54) IMAGE FORMING APPARATUS FEATURING REDUCED SHOCK ATTRIBUTABLE TO A SPEED DIFFERENCE BETWEEN A DRIVING GEAR AND A DRIVEN GEAR OF A DEVELOPING DEVICE

(75) Inventor: Akinori Tanaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 208 days.

(21) Appl. No.: 11/530,640

(22) Filed: Sep. 11, 2006

(65) Prior Publication Data

US 2007/0059043 A1 Mar. 15, 2007

(30) Foreign Application Priority Data

Sep. 12, 2005 (JP) ..... 2005-264490

(51) Int. Cl.
*G03G 15/01* (2006.01)

(52) U.S. Cl. ..... 399/227

(58) Field of Classification Search ..... 399/227
See application file for complete search history.

(56) References Cited

U.S. PATENT DOCUMENTS

| | | | | |
|---|---|---|---|---|
| 6,175,705 | B1 * | 1/2001 | Harada et al. | 399/117 |
| 6,813,459 | B2 * | 11/2004 | Kishigami | 399/227 |
| 6,968,145 | B2 | 11/2005 | Kishigami | 399/227 |

FOREIGN PATENT DOCUMENTS

| | | | |
|---|---|---|---|
| JP | 11-184201 | | 7/1999 |
| JP | 2002-178561 | | 6/2002 |
| JP | 2003-35981 | | 2/2003 |
| JP | 2003-58009 | | 2/2003 |
| JP | 2003-208013 | | 7/2003 |
| JP | 2003-208014 | | 7/2003 |
| JP | 2004-37599 | | 2/2004 |
| JP | 2005017668 | A * | 1/2005 |

* cited by examiner

*Primary Examiner*—Quana M Grainger
(74) *Attorney, Agent, or Firm*—Fitzpatrick, Cella, Harper & Scinto

(57) ABSTRACT

An image forming apparatus includes an image bearing member on which an electrostatic image is formed by imagewise exposure; a rotatable member; a developing device carried on said rotatable member and movable, by rotation of said rotatable member, to a developing position where said developing device is opposed to said image bearing member; a driven gear which is provided in said developing device and which receives a driving force for operating said developing device; and a driving gear, provided in a main assembly of the apparatus, for driving engagement with said driven gear of said developing device which is located at the developing position, wherein said driving gear, when said developing device is moving toward the developing position, is driven such that moving direction thereof is the same as a moving direction of said driven gear at an engagement portion with said driven gear, wherein upon driving engagement between said driven gear and said driving gear, a peripheral speed VA of said driven gear which is being moved by said rotatable member on an addendum circle thereof at said engagement portion and a peripheral speed VB of said driving gear on an addendum circle thereof satisfy $0.9 \leqq VA/VB \leqq 1.0$.

1 Claim, 14 Drawing Sheets

IMAGE FORMING APPARATUS FEATURING REDUCED SHOCK ATTRIBUTABLE TO A SPEED DIFFERENCE BETWEEN A DRIVING GEAR AND A DRIVEN GEAR OF A DEVELOPING DEVICE

FIELD OF THE INVENTION AND RELATED ART

The present invention relates to an image forming apparatus for use with a copying machine, a printer, a facsimile machine or the like, the image forming apparatus comprising a rotary type developing device which includes a plurality of developing devices for multi-color development of electrostatic images formed through an electrophotographic type or electrostatic recording type process with two or more color developers, wherein the developing devices are carried on a rotatable developing rotary.

As for the full-color image forming apparatus of the electrophotographic type which becomes increasingly popular, downsizing and high image quality are demanded.

In order to meet the demand, many proposals have been made as to an image forming apparatus using a rotary development structure, in which one electrophotographic photosensitive member (image bearing member in the form of a photosensitive drum) is used, and a rotary type developing device is disposed opposed to the photosensitive drum. The rotary type developing device includes a developing rotary which carries a plurality of developing devices, and by rotating the developing rotary, a necessary one of the developing devices is brought to oppose the photosensitive drum.

Typical examples of the rotary type developing device are disclosed in Japanese Laid-open Patent Applications 2002-178561 and 2003-58009.

Such a rotary type developing device is advantageous in the space saving since the plurality of developing devices are carried on the developing rotary. In addition, since the developing position relative to the photosensitive drum is constant irrespective of the color, the toner content is stabilized; since only one drum is employed for all colors, color misregistration is small; and therefore, the high image quality is expected.

A characteristic structure of the rotary type developing device will be described.

The driving force is supplied externally to rotate the developing rotary for switching the developing device and to rotate a developing sleeve and a stirring screw of the developing device mounted on the developing rotary.

The timing of externally supplying the driving force to the developing sleeve and the stirring screw of the developing device mounted on the developing rotary will be described. Since the developing device has to be driven during image forming operation, the drive input timing to the developing device is after the developing rotary stops or slightly before the developing rotary stops.

This means that timing of the stop of the developing rotary and the timing of drive supply or connection to the developing device are quite close to each other.

In addition, the drive input timing to the developing device overlaps the start timing of the image exposure or overlaps the duration of the image exposure, in many cases.

Therefore, the vibration due to the impact produced mainly by rotation inertia upon the stop of the developing rotary is overlapped with the vibration due to the impact produced upon the developing drive input or developing drive connection when the drive is supplied or inputted to the developing sleeve and/or to the stirring screw and so on. Therefore, the vibration may be enhanced by the combination of them, or the exposure operation is disturbed by such vibrations, with the result of dark-light patterns with the same intervals of the vibrations in the resultant image.

Particularly if these vibrations are overlaid with each other, a very significant image defect may be produced.

Various proposals have been made to solve the problem, particularly in the drive input portion to the developing device.

For example, Japanese Laid-open Patent Application Hei 11-184201 discloses that play is provided in the rotational direction for the gear which is fixed in the main assembly side of the image forming apparatus and which functions to input the drive (driving force) to the developing device. With such a structure, upon the contact between the teeth of the drive input gear and the teeth of the driven gear provided in the developing device, the gears can freely rotate by the amount of the play so that impact can be eased.

In another example disclosed in Japanese Laid-open Patent Application 2003-35981 and Japanese Laid-open Patent Application 2004-37599, the teeth of the drive input gear and the teeth of the driven gear provided in the developing device are sharpened to improve the engagement between the gears. With such a structure, the abutment between the gears is eased, so that impact upon the engagement can be avoided or eased.

Japanese Laid-open Patent Application 2003-208013 and 2003-208014 propose another example. In this example, there is provided a drive transmitting portion which transmits the driving force from the driving source outside the developing rotary to the developing device mounted on the developing rotary. In the drive transmitting portion, a driving shaft for transmitting the drive to the developing device is swingably supported on a line connecting the centers of the developing rotary and the driven gear of the developing device mounted on the developing rotary. By doing so, the collision between the teeth of the gears can be avoided; the impact of the collision can be eased; the generation of the vibration can be eased; and/or the damage of the tooth can be avoided.

The proposals discussed above are directed to the prevention of the impact upon the collision of the tooth or to the problem with the drive transmission resulting therefrom.

As regards the impact upon the drive stop of the developing rotary, the following measures are taken in many cases. The moment of inertia of the developing rotary is reduced purely mechanically, or the developing rotary is driven by a stepping motor in which the driving table of the stepping motor is profiled to suppress the impact. Alternatively, the developing rotary is provided with a variable type or constant type friction brake.

From the foregoing, in order for the proper image formation without image deterioration attributable to the vibration, the following is desirably prevented. Namely, the vibration produced by the impact mainly due to the inertia of the developing rotary upon the stop of the developing rotary carrying the developing devices, and the impact upon the developing drive input or developing drive connection when the drive is transmitted to the developing sleeve and the stirring screw.

As regards the stop of the developing rotary, there is an alternative countermeasurement wherein the stepping motor which is the developing rotary driving motor is driven with fine driving step angles. Further alternatively, a braking or load resistance applying mechanism is provided against the developing rotary to absorb the reaction force due to the stop. These methods are effective to significantly reduce the vibration and or the impact upon the stop of the developing rotary.

As regards the impact upon the developing drive input or developing drive connection, there is a method as disclosed in Japanese Laid-open Patent Application Hei 11-184201 wherein the impact is eased by the provision of the play in the rotational direction of the gears. In addition, the sharpening of the teeth end portion shown in Japanese Laid-open Patent Applications Nos. 2003-35981 and 2004-37599 is also effective to reduces the collision of the teeth per se or the impact produced by the collision. Furthermore, as disclosed in Japanese Laid-open Patent Application No. 2003-208013 and 2003-208014, the driving shaft is swingably supported by which the collision between the teeth of the gears is avoided; the impact due to the collision of the teeth is eased; the generation of the vibration is prevented; or the damage of the teeth top due to the collision can be avoided. By using such structures, the impact can be avoided upon the driving and driven gears being brought into meshing engagement with each other.

However, when the drive (driving force) is inputted to the rotating developing device, there is a problem even if the gears are brought into engagement with each other with the eased impact under the condition that developing sleeve, the stirring screw and so on are not rotating.

Even if the developing sleeve, the stirring screw and so on are at rest, an abrupt driving force applied thereto produces a vibration or impact at the drive inputting portion by the reaction force corresponding to the load torque of the developing device. This may result in a drive transmission defect, for the developing device, attributable to the vibration in the drive inputting portion, and therefore, result in an image defect such as image non-uniformity.

In addition, if the reaction force corresponding to the load torque of the developing device is transmitted to the developing rotary immediately before the stop by way of the vibration and/or impact, the stepping motor drive for reduction of the vibration upon the stop of the developing rotary is disturbed, with the result of the increase of the vibration upon the stop. Furthermore, there is a liability that step-out of the stepping motor which may leads to failure of rotary driving occurs, or the stop position is not correctly determined, namely, the malfunction of the main assembly of the image forming apparatus results.

The reaction force corresponding to the load torque of the developing device at the time of the developing drive connection is different depending on the rotational speed of the developing sleeve and/or the stirring screw, an amount of the developer contained in the developing device, a pressure applied to the developer and so on. The recent demand toward high speed image formation and high quality image formation require an increased rotational speed, an increased developer capacity and an increased pressure to the developer.

Thus, the above-described reaction force tends to increase.

When the high quality of the image is further pursued, a relatively quite insignificant image defect attributable to a small level vibration has to be avoided, and therefore, the countermeasurement against the generation of the shock and/or vibration is desired.

SUMMARY OF THE INVENTION

Accordingly, it is a principal object of the present invention to provide an image forming apparatus in which generation of the shock attributable to the speed difference between a driving side and a driven side at the time of establishing drive transmission.

According to an aspect of the present invention, there is provided an image forming apparatus comprising an image bearing member on which an electrostatic image is formed by imagewise exposure; a rotatable member; a developing device carried on said rotatable member and movable, by rotation of said rotatable member, to a developing position where said developing device is opposed to said image bearing member; a driven gear which is provided in said developing device and which receives a driving force for operating said developing device; and a driving gear, provided in a main assembly of the apparatus, for driving engagement with said driven gear of said developing device which is located at the developing position, wherein said driving gear, when said developing device is moving toward the developing position, is driven such that moving direction thereof is the same as a moving direction of said driven gear at an engagement portion with said driven gear, wherein upon driving engagement between said driven gear and said driving gear, a peripheral speed VA of said driven gear which is being moved by said rotatable member on an addendum circle thereof at said engagement portion and a peripheral speed VB of said driving gear on an addendum circle thereof satisfy $0.9 \leqq VA/VB \leqq 1.0$.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

The preferred embodiments of the present invention will be described in conjunction with the accompanying drawings.

Embodiment 1

Figure 1:
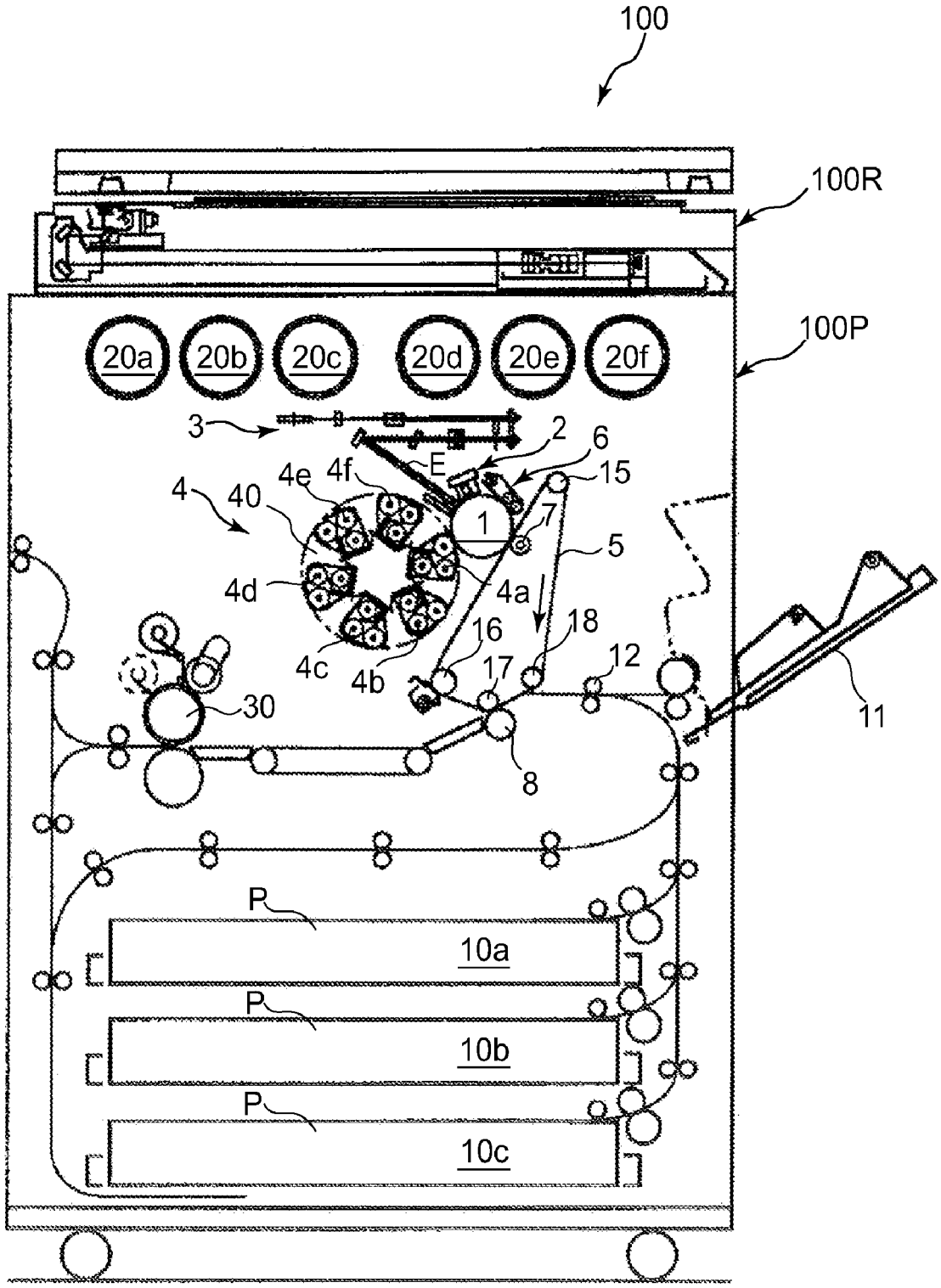
FIG. 1 is a schematic sectional view of an image forming apparatus according to an embodiment of the present invention.

Referring to FIG. 1, there is shown an electrophotographic type color image forming apparatus which is an exemplary image forming apparatus according to an embodiment of the present invention.

The color image forming apparatus 100 of this embodiment comprises a digital color image reader portion 100R at an upper portion and a digital color image printer station 100P at a lower portion. It is a one-drum rotary development type and intermediary transfer type apparatus (full-color image forming apparatus).

First, the general arrangement of the image forming apparatus will be described.

An original read by the reader portion 100R is converted to a light signal for each of colors (each of color stations) by a laser output portion (unshown). The laser beam modulated in accordance with the light signal is reflected by a polygonal mirror and is projected onto a surface of the photosensitive drum 1 by way of a lens and folding mirrors.

In the digital color image printer station 100P, as shown in FIG. 1, a rotary type developing device 4 is provided opposed to the electrophotographic photosensitive member (photosensitive drum 1) which is supported for rotation in the direction indicated by the arrow.

The rotary type developing device 4 comprises a rotatable member rotatably supported, namely, a developing rotary 40 which carries a plurality of developing devices. In this embodiment, the developing rotary 40 carries developing devices for six colors, namely, LM (light magenta) 4*a*, LC (light cyan) 4*b*, Y (yellow) 4*c*, M (dark color magenta) 4*d*, C (dark color cyan) 4*e*, and K (black) 4*f*. The developing device 4*a* (light magenta developing device), 4*b* (light cyan developing device), 4*c* (yellow developing device), 4*d* (dark color magenta), 4*e* (dark color cyan developing device) and 4*f* (black developing device) have the same structures except that they contain the different color developers.

Around the photosensitive drum 1, there are provided a charger 2 (primary charging means), an intermediary transfer belt 5 (intermediary transfer member) and a cleaning device 6 (cleaning means). The intermediary transfer belt 5 is extended around a plurality of supporting rollers 15, 16, 17, 18 and is rotated in the direction indicated by the arrow.

In the image forming a process, the surface of the photosensitive drum 1 is first uniformly charged by the charger 2. The surface of the charged photosensitive drum 1 is exposed to a laser beam E from the laser scanner apparatus 3 (exposure means), by which an electrostatic latent image is formed on the photosensitive drum 1.

In order to develop the electrostatic latent image, the rotary type developing device 4 is rotated in the direction indicated by the arrow to switch the developing device so that necessary ones of the developing devices 4*a*, 4*b*, 4*c*, 4*d*, 4*e*, 4*f* is opposed to the photosensitive drum 1 (developing position). At the developing position, the developing device is operated to develop the electrostatic latent image on the photosensitive drum 1 to provide a visualized image, that is, a toner image on the photosensitive drum 1.

The toner image formed on the photosensitive drum 1 is transferred onto the intermediary transfer belt 5 by a transfer bias voltage provided by a primary transfer roller 7 (primary transferring means) each time it is formed, and the toner images provided by the developing devices are superimposed on the intermediary transfer belt 5. Thus, the respective toner images are sequentially overlaid on the intermediary transfer belt 24 so that full-color toner image is formed on intermediary transfer belt 24.

The image forming apparatus of this embodiment uses developing devices for a light magenta color and a light cyan color in addition to the developing devices for the normal yellow, cyan, magenta and black colors (four colors). Corresponding to the six developing devices 4*a*, 4*b*, 4*c*, 4*d*, 4*e*, 4*f*, there are provided six toner cartridges 20*a*, 20*b*, 20*c*, 20*d*, 20*e*, 20*f*.

The light magenta LM and the light cyan LC are used to reduce a granular nature of a half-tone portion of the image and to form half-tone portion of the image stably.

The recording paper P is picked up from cassettes 10*a*, 10*b*, 10*c* or from multiple manual feeder, and is fed to registration rollers 12 where it is subjected to the inclination correction and is refed at a proper timing toward a secondary transfer roller 8 provided in the image transfer portion.

Thereafter, at the transfer position of the image transfer portion 8, the recording paper P is contacted to the toner image on the intermediary transfer belt 5 which travels similarly so that toner image is transferred onto the recording paper.

The recording paper having passed through the image transfer portion 8 is fed to the fixing portion 30 where the toner image is fixed by heat on a recording paper P. Then, the recording paper P is discharged from the apparatus, or refed into the apparatus for both sides image formation process, if necessary.

The remaining toner remaining on the photosensitive drum 1 after the image transfer operation is removed by a cleaner 6.

Figure 2:
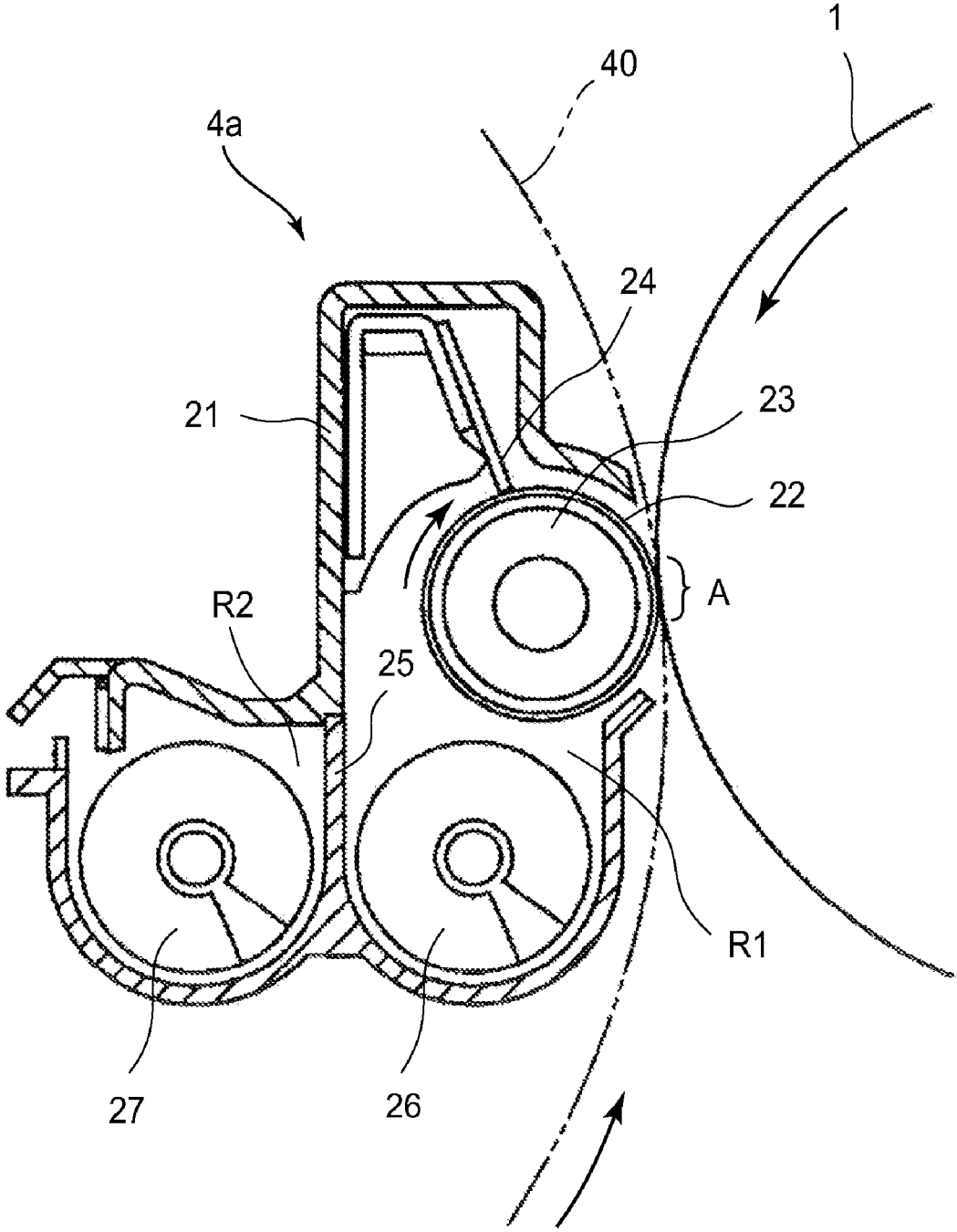
FIG. 2 is a schematic sectional view of a developing device according to the embodiment of the present invention.

Referring to FIG. 2, the description will be made as to the developing device in detail. The six developing devices 4*a*, 4*b*, 4*c*, 4*d*, 4*e*, 4*f* have the same structures except that they contain different color developers. The description will be made only as to the light magenta developing device 4*a* for the sake of simplicity, but the same description applies to the other developing devices.

The developing device 4*a* includes a developing container 21, which contains a two component developer comprising non-magnetic toner particles and magnetic carrier particles, in this embodiment.

The developing container 21 includes a developing sleeve 22 (developer carrying member) which is rotatably supported, and the developing sleeve 22 contains a fixed magnet 23 (magnetic field generating means). When the developing device 4*a* is moved to the developing position, the developing sleeve 22 forms a developing zone A opposed to the photosensitive drum 1.

The developing sleeve 22 comprises non-magnetic material and rotates in the direction indicated by the arrow in FIG. 2 during the developing operation to carry a layer of the two component developer from the developing container 21 into the developing zone A. The developer layer on the developing sleeve 22 is regulated into a predetermined layer thickness by a regulating blade 24. The developing sleeve 22 supplies that two component developer into the developing zone A where it is opposed to the photosensitive drum 1, so that it develops the electrostatic latent image formed on the photosensitive drum 1. The developer, after the electrostatic latent image is developed, is fed by the rotation of the developing sleeve 22 and is collected into the developing container 21.

The developing sleeve 22 is supplied with a developing bias voltage in the form of an AC biased DC voltage from an unshown developing bias. The AC component has a waveform which is rectangular wave and has a frequency of 2 kHz and a peak-to-peak voltage of Vpp=2 kV. The developing bias voltage forms an alternating electric field between the developing sleeve 22 and the photosensitive drum 1 to electrically separate the toner from the carrier to provide toner mist. Doing so is effective to improve the development efficiency.

The description will be made as to the two component developer.

The toner is produced by pulverizing kneaded pigment and resin material binder mainly comprising polyester resin and classifying the pulverized resin material. In order to improve the flowability, the chargeable and the environmental stability, ultra-fine particles are externally added. The toner has a volume average particle size of approx. 8 μm. The carrier particle comprises a core mainly comprising ferrite material and silicon resin material coating it. The carrier particle has a 50% particle size (D50) of 40 μm. Such toner and carrier particles are mixed at a ratio of approx. 8:92 to provide the two component developer having a toner content (TD ratio) of 8%.

The used light color and dark chromatic toners were adjusted in the percentage of the pigments to exhibit optical densities of 0.8 and 1.6 per 0.5 mg/cm$^2$ of the amount of toner, respectively, on the transfer material P, namely, recording paper. In other words, in this embodiment, the pigment parts of the light chromatic toner are ⅕ of those of the dark chromatic toner.

The description will be made as to the phenomenon related with the present invention.

Figure 3:
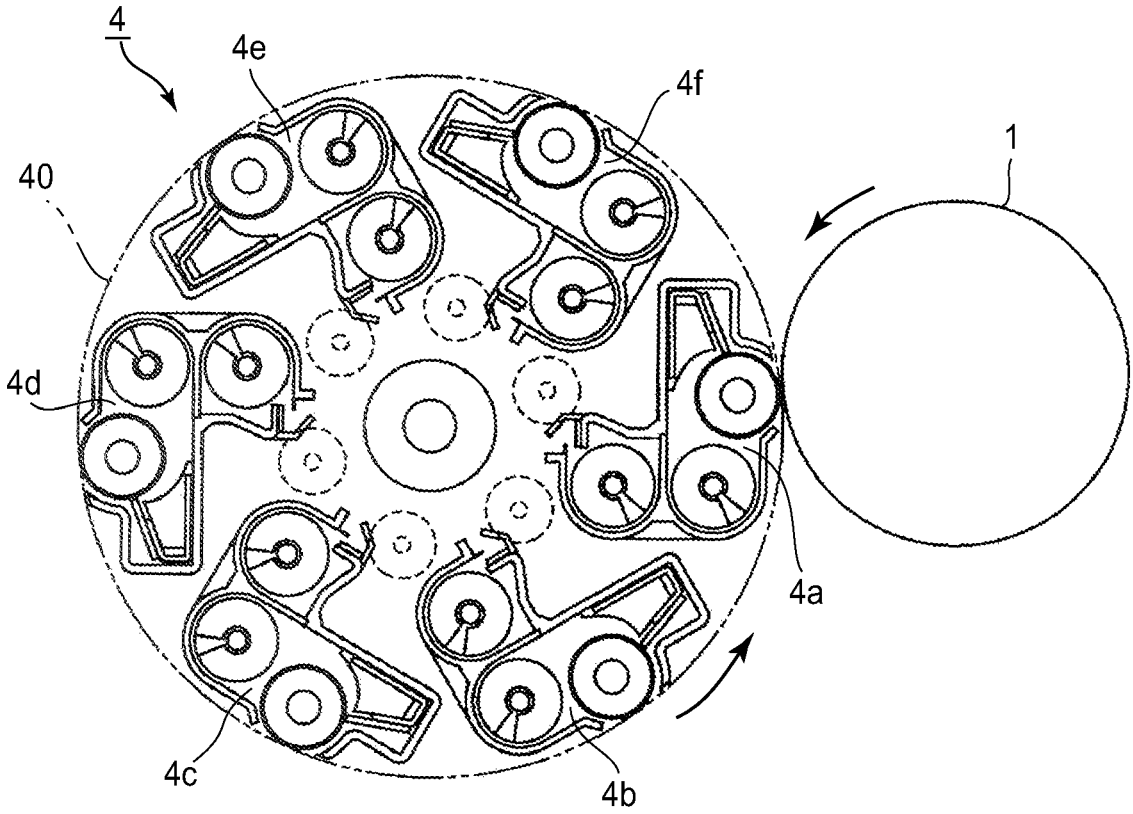
FIG. 3 is a schematic sectional view of a rotary type developing device according to the embodiment of the present invention.

Referring to FIG. 3, the rotary type developing device 4 of this embodiment is shown.

As described hereinbefore, the colors of the developers contained in the developing devices 4*a*-4*f* are yellow (developing device 4*c*), magenta (developing device 4*d*), cyan (developing device 4*e*), and black (developing device 4*f*) (4 colors). In addition, there are light magenta (developing device 4*a*) and light cyan (developing device 4*b*), and therefore, the developing rotary is six-color color developing rotary.

The developing rotary 40 of this embodiment rotates in the counterclockwise direction in FIG. 3, and therefore, the order of developing operation of the image forming apparatus is as follows. That is, developing device 4*a* (light magenta LM); developing device 4*b* (light cyan LC); developing device 4*c* (yellow Y); developing device 4*d* (magenta M); developing device 4*e* (cyan C) developing device 4*f* (black K).

Figure 4:
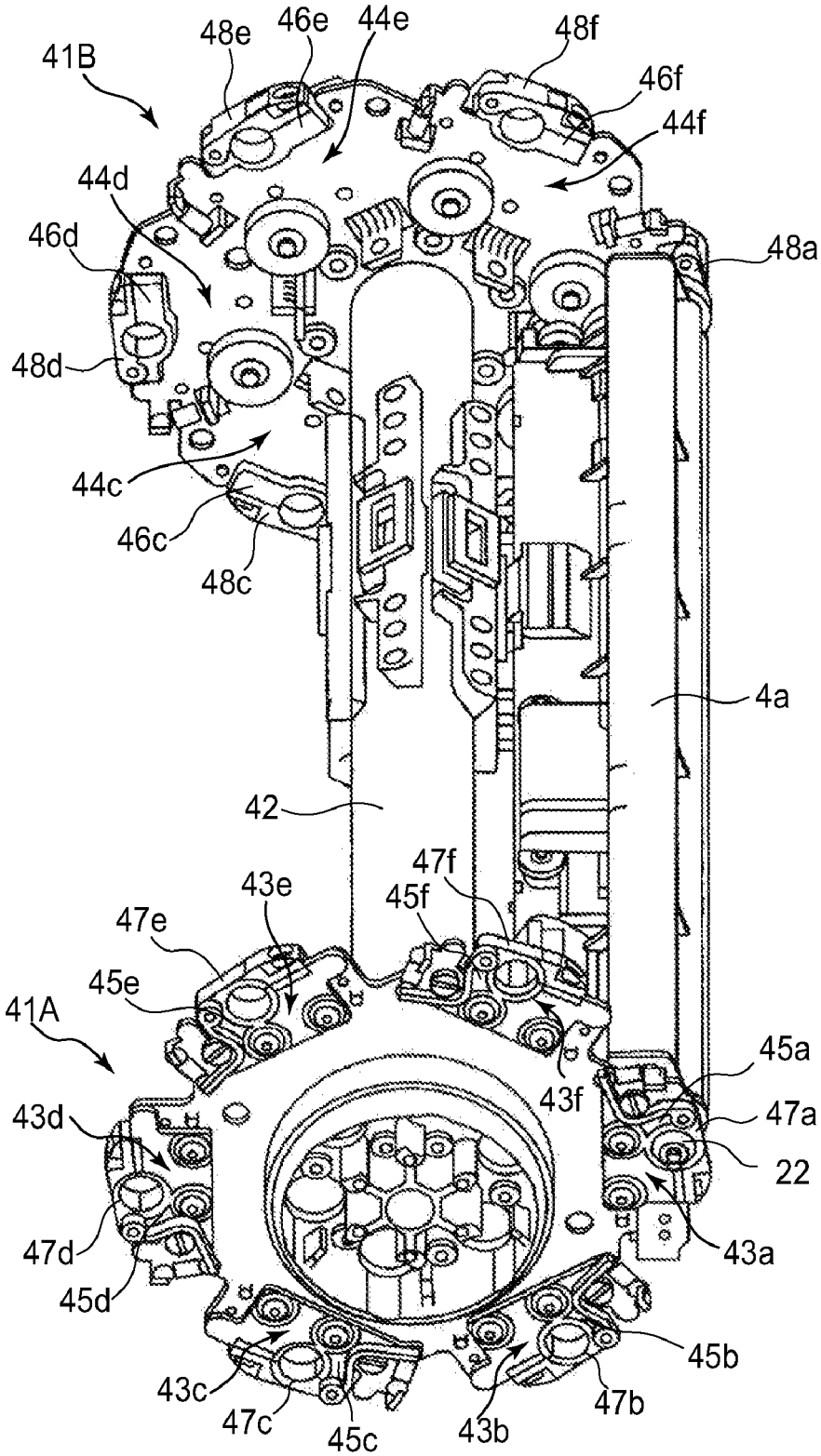
FIG. 4 is a perspective view illustrating a developing rotary according to an embodiment of the present invention, used in the rotary type developing device.
Figure 5:
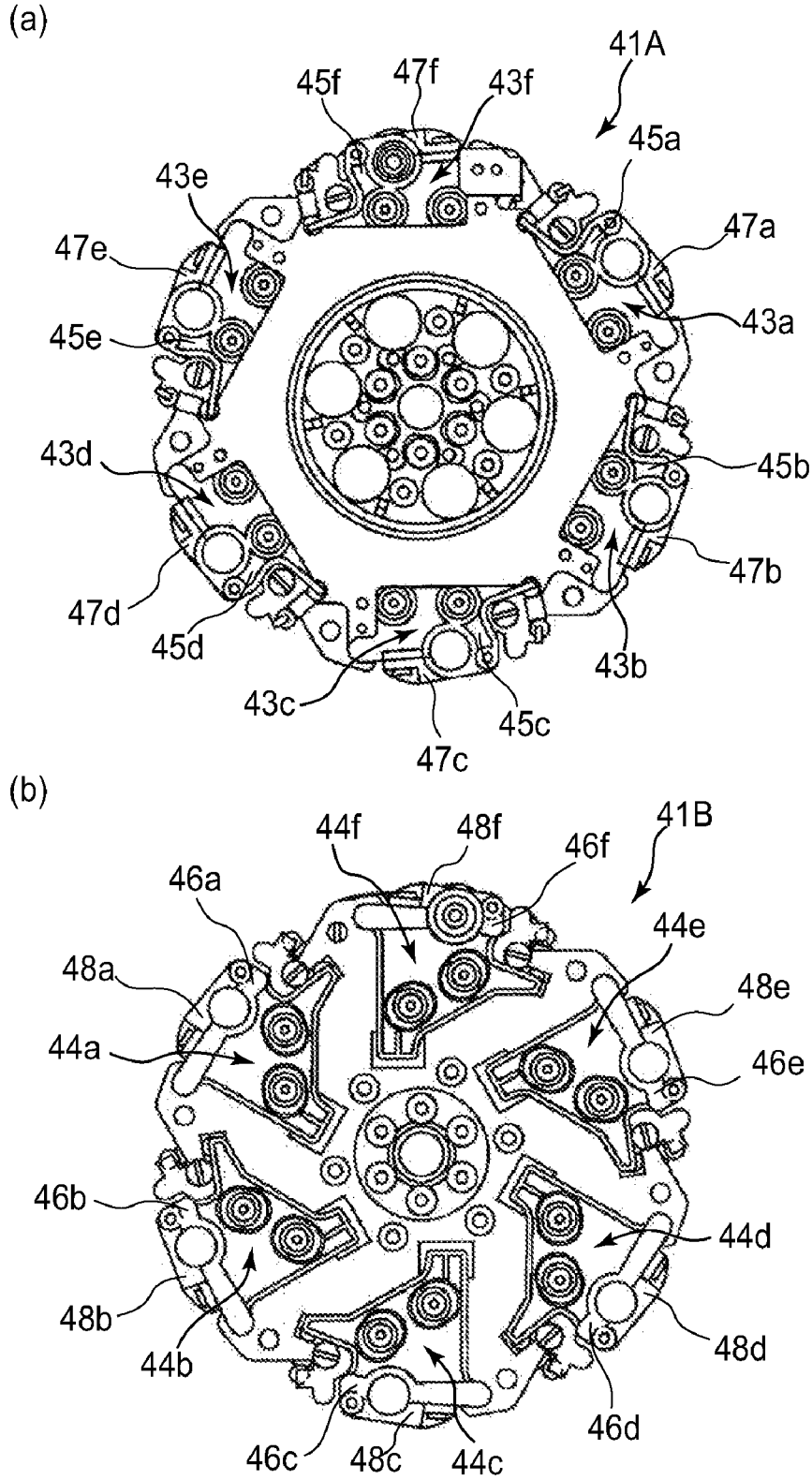
FIG. 5, (a) illustrates a front side of the developing device mounting portion in the developing rotary, and FIG. 5, (b) illustrates a rear side of the developing device mounting portion in the developing rotary.

Referring to FIGS. 4 and 5, (a), (b), the description will be made as to a developing device mounting portion for mounting each of the developing devices 4*a*-4*f* on the developing rotary 40. FIG. 4 shows one of the developing devices 4*a* which is mounted on the developing rotary 40. The other developing devices 4*b*-4*f* are mounted similarly to the developing device 4*a*.

The developing rotary 40 comprises a rotary front side plate 41A disposed adjacent to a front side plate of the main assembly of the apparatus; a rotary rear side plate 41B disposed adjacent to a rear side plate of the main assembly of the apparatus; and a rotation center shaft 42 which integrally connect the rotary front side plate 41A and the rotary rear side plate 41B.

The rotary side plates 41A, 41B which are disposed at the front and rear sides of the developing rotary 40 are provided with developing device mounting portions 43*a*-43*f* (front side plate side) and 44*a*-44*f* (rear side plate side), respectively.

The mounting portions 43*a*-43*f* of the rotary front side plate 41A include sleeve holder portions 45*a*-45*f* (front side plate side) for holding one end portions of the developing sleeves 22 of the developing devices 4*a*-4*f*, and sleeve pushing portions 47*a*-47*f* (front side plate side), respectively. The mounting portions 44*a*-44*f* of the rotary rear side plate 41B include sleeve holder portions 46*a*-46*f* (rear side plate side) for holding the other end portions of the developing sleeves 22 of the developing devices 4*a*-4*f*, and sleeve pushing portions 48*a*-48*f* (rear side plate side).

As will be understood from FIG. 4, the sleeve holder portions 45*a*-45*f* (front side plate side) and 46*a*-46*f* (rear side plate side) have bearing portions which receive the bearing portions of the end portions of the developing sleeves 22 of the developing devices 4*a*-4*f*, respectively. The bearing portions of the developing sleeves 22 engaged with the sleeve holder portions 45*a*-45*f* (front side plate side) and 46*a*-46*f* (rear side plate side) are confined and fixed by the sleeve pushing portions 47*a*-47*f* (front side plate side) and 48*a*-48*f* (rear side plate side).

In this embodiment, the developing devices 4*a*-4*f* are disposed at the regular intervals of 60° in the developing rotary 40.

Figure 6:
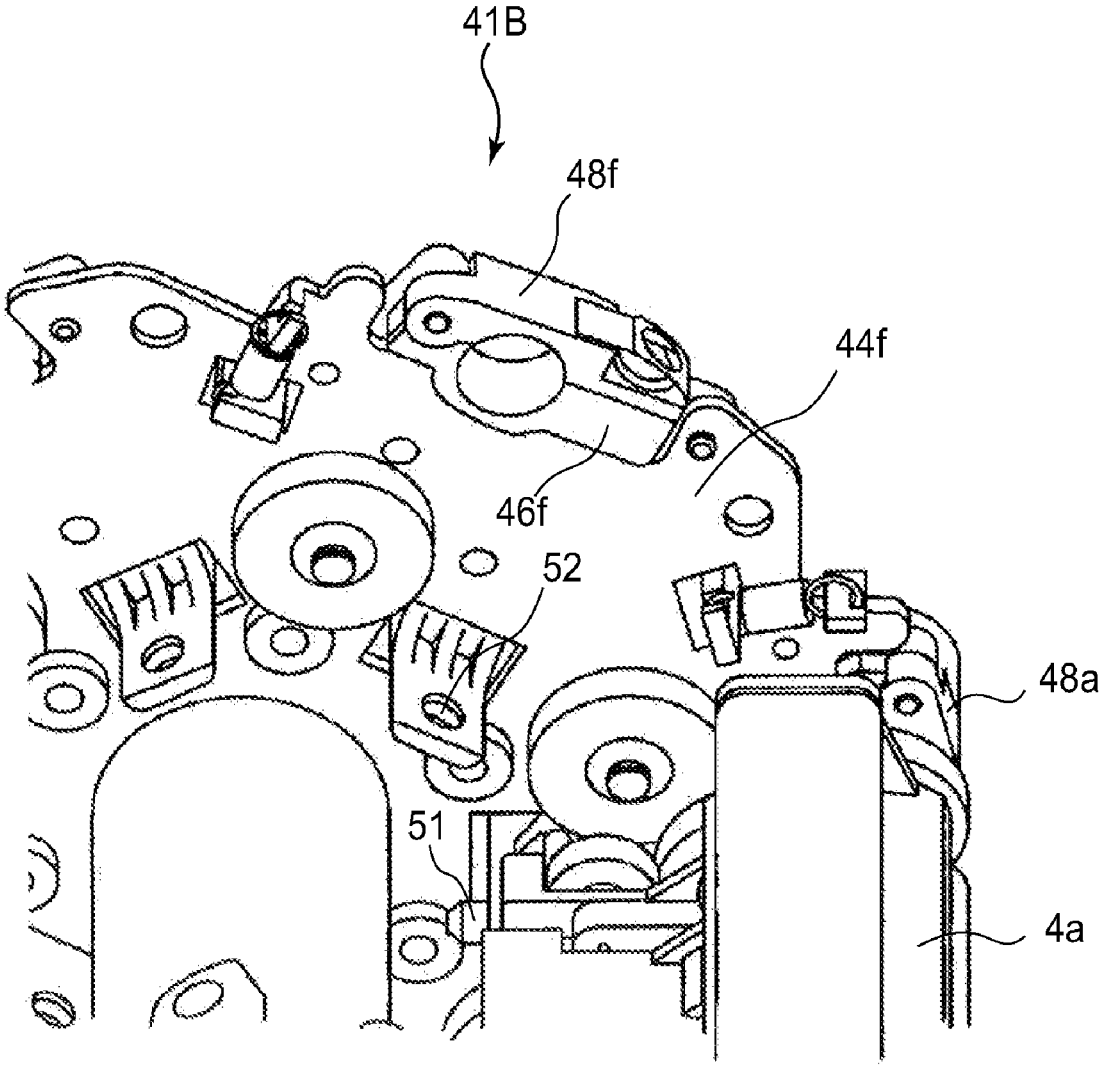
FIG. 6 is a perspective view illustrating a developing device fixing portion in the developing rotary.

As shown in FIG. 6, in this embodiment, the sleeve holder portions 46*a*-46*f* provided at the rear side plate side are provided with engaging holes 52, and the containers of the developing devices are provided with engagement pins 51 projected therefrom, wherein the engaging holes 52 are engaged with the engagement pins 51, respectively, by which the attitudes of the developing devices are maintained.

As described above, the developing devices 4*a*-4*f* containing the color developers are fixed on the developing rotary 40. Thereafter, the sleeve holder portions 45*a*-45*f* (front side plate side) and 46*a*-46*f* (rear side plate side) are fixed to the front and rear rotary side plates 41A, 41B of the developing rotary 40, while the distances between the developing sleeves 22 and the photosensitive drums 1 are adjusted to be desired distances.

By doing so, the gap between the developing sleeves 22 of the developing devices 4*a*-4*f*, respectively, are assured during the developing process operation.

As described above, in the image forming apparatus of this embodiment, the developing device in operation is switched for the colors, and the developing operation is repeated so that latent images are developed. Each time the developing operation is carried out, the toner image is transferred onto the intermediary transfer belt 5. By a desired times of rotations of the intermediary transfer belt 5, the images are superposed on the intermediary transfer belt 5.

Image formation modes of the image forming apparatus of this embodiment will be described.

The image forming apparatus of this embodiment provides a photograph-like image with a very little granular nature by the six color image formation. However, the image forming apparatus of this embodiment of the present invention is operable in either of two image formation modes, namely, a six color image formation mode and a four color image formation mode, so that image forming operation is possible for full-color image formation or for four color image formation.

Figure 7:
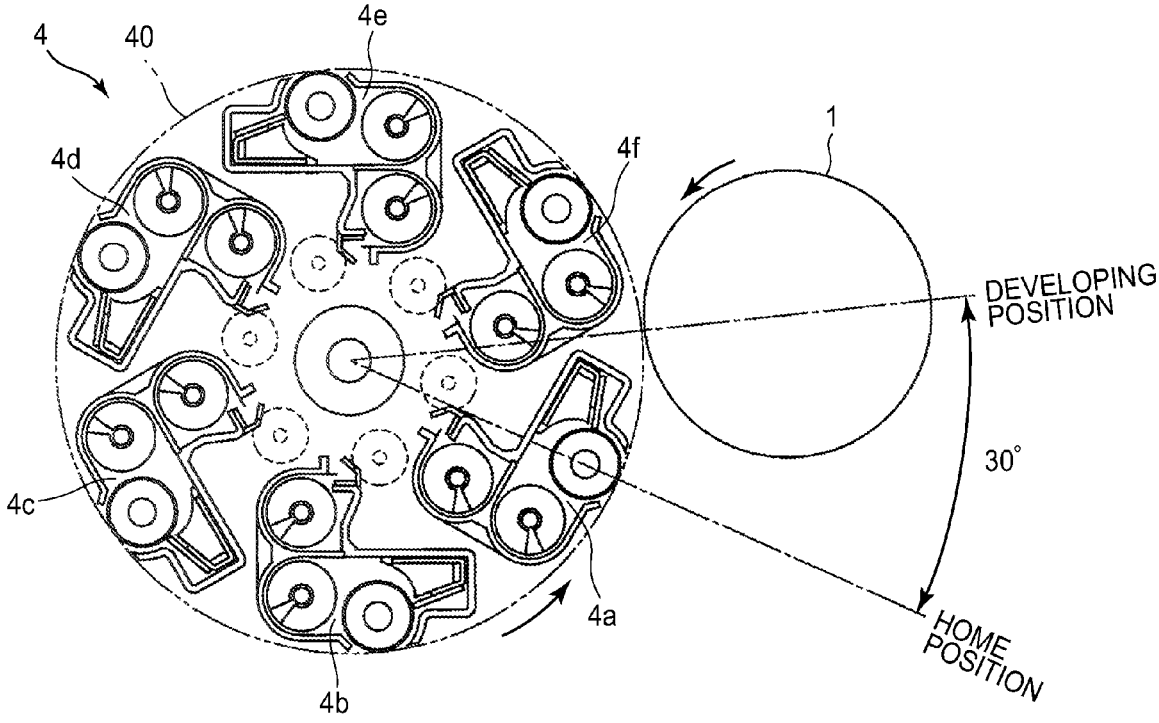
FIG. 7 illustrates the developing rotary placed at its home position.

FIG. 7 shows the developing rotary 40 when the image formation is not carried out (home position).

As will be understood from the Figure, the home position is 30° away from the position where the developing device 4*a* as shown in FIGS. 1 and 2 is at the developing position toward the upstream with respect to the rotational direction of the development rotary. This is common to all of the image formation modes.

Figure 8:
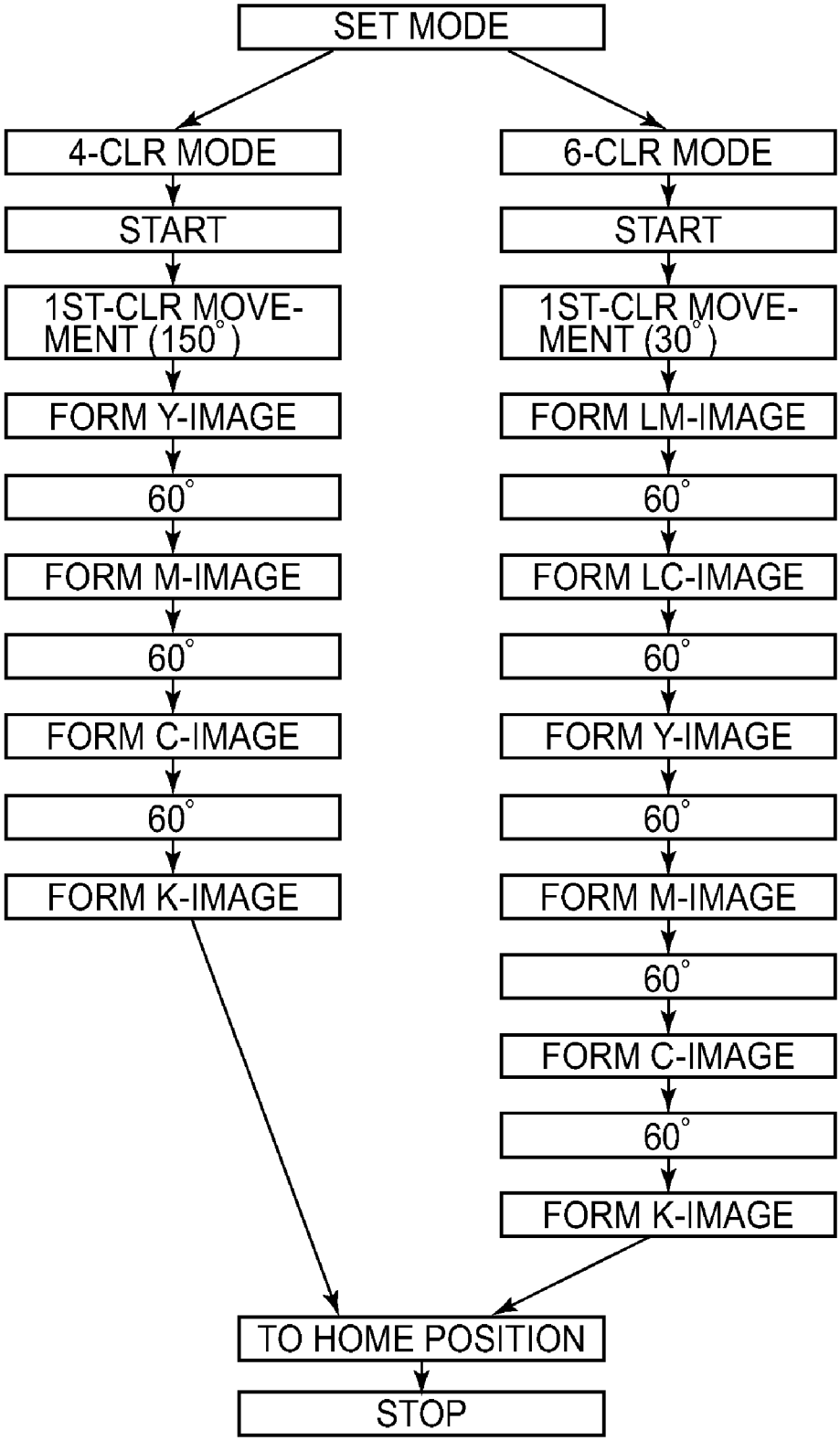
FIG. 8 is a flow chart of an operation in an image formation mode in the image forming apparatus according to the embodiment of the present invention.

FIG. 8 is a flow chart of the driving operations of the developing rotary 40 in the respective image formation modes.

When the six-color image formation mode is selected, the developing rotary 40 rotates in the counterclockwise direction from the home position by 30° in FIG. 7 so that first color developing device 4*a* is placed at the developing position, and the developing operation is carried out.

Thereafter, for each of the image forming processes, the developing rotary 40 rotates through 60° counterclockwise, so that image forming processes including the image forming processes are carried out in the predetermined order. In this embodiment, after the operation of the developing device 4*a* (light magenta LM), the developing device 4*b* (light cyan LC), the developing device 4*c* (yellow Y), the developing device 4*d* (magenta M), the developing device 4*e* (cyan C), the developing device 4*f* (black K) are brought to the developing position to carry out the developing operations for the respective colors in the order named.

When the developing operation for the black color (sixth color) by the developing device 4*f* is completed, the developing rotary 40 is moved to the home position (HP) and is stopped there.

On the other hand, when the four-color image formation mode is selected, the developing device 4*a* (light magenta LM) or the developing device 4*b* (light cyan LC) are not used. Therefore, in this embodiment, the developing rotary 40 is rotated by 150° to bring the first color (yellow color) developing device 4*c* to the developing position. Then, the developing device 4*c* carries out the yellow color developing operation for the first color.

Thereafter, for each of the image forming processes, the developing rotary 40 rotates through 60° counterclockwise, so that image forming processes including the image forming processes are carried out in the predetermined order. In this embodiment, after the developing operation of the developing device 4*c* (yellow Y), the developing device 4*d* (magenta M), the developing device 4*e* (cyan C) and the developing device 4*f* (black K) are brought to the developing position in the order named to effect the developing operations for the predetermined colors.

When the developing operation for the fourth color (black color) by the developing device 4*f* is completed, the developing rotary 40 returns to the home position and stops there.

In this embodiment, after the completion of the developing operation of the developing device 4*f* for black color, the home position sensor signal renders ON when the developing rotary 40 rotates by 15°, by disposition of a flag and a sensor. The home position is set at a position reached by 15° rotation after the signal detection.

The developing rotary 40 is driven by a stepping motor, and the angle of rotation is set by the number of driving pulses.

The description will be made as to the structure for the developing drive and the structure for drive input to the developing rotary.

Figure 9:
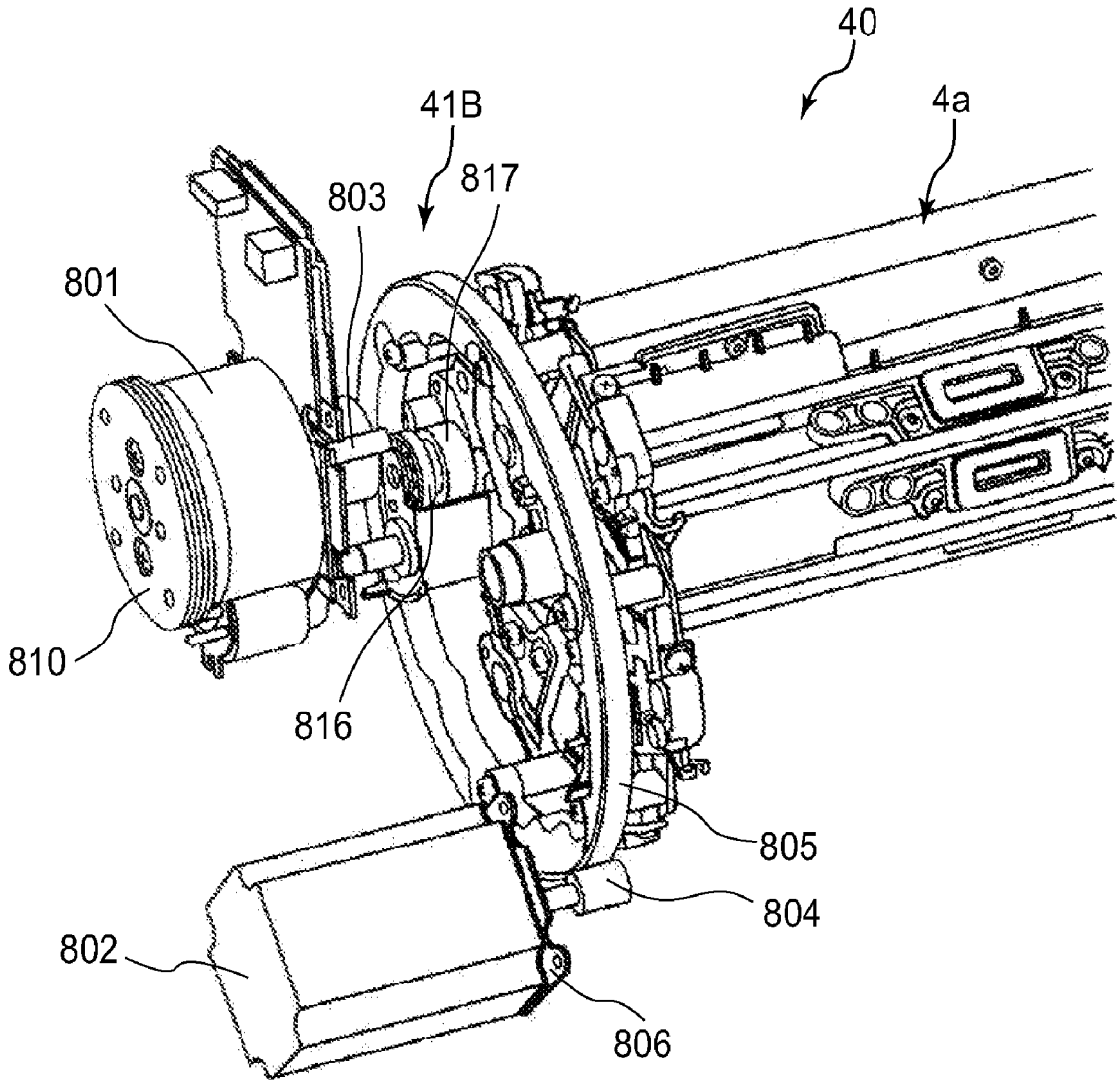
FIG. 9 is a perspective view illustrating the developing rotary and a developing drive input portion.

FIG. 9 shows the developing rotary 40 which carries one developing device 4*a*, similarly to FIG. 4. The structure for the drive (force) input to the developing device and the rotary driver are additionally shown. However, the developing rotary 40 is oriented differently.

The developing rotary 40 is provided with a rotary gear 805 and is driven through a rotary motor gear 804 by a rotary driving motor 802 for the developing rotary 40 only.

The rotary motor 802 does not drive any element other than the developing rotary, and rotates the rotary with a driving table exclusively therefor.

The drive input to the developing device is carried out by the drive transmission from the developing drive motor gear 803 mounted on the developing drive motor 801.

The developing drive motor 801 is a brushless DC motor and is mounted in a developing drive unit exclusively therefor. The developing drive unit is mounted on a rear side plate of the main assembly frame of the image forming apparatus.

The rotary motor 802 is mounted on the rear side plate of the main assembly frame through a rubber mount 806 for vibration attenuation, similarly to the developing drive unit. The developing rotary is mounted on an unshown process kit frame, wherein the developing rotary, the developing drive unit, the rotary motor are independent from each other.

Figure 10:
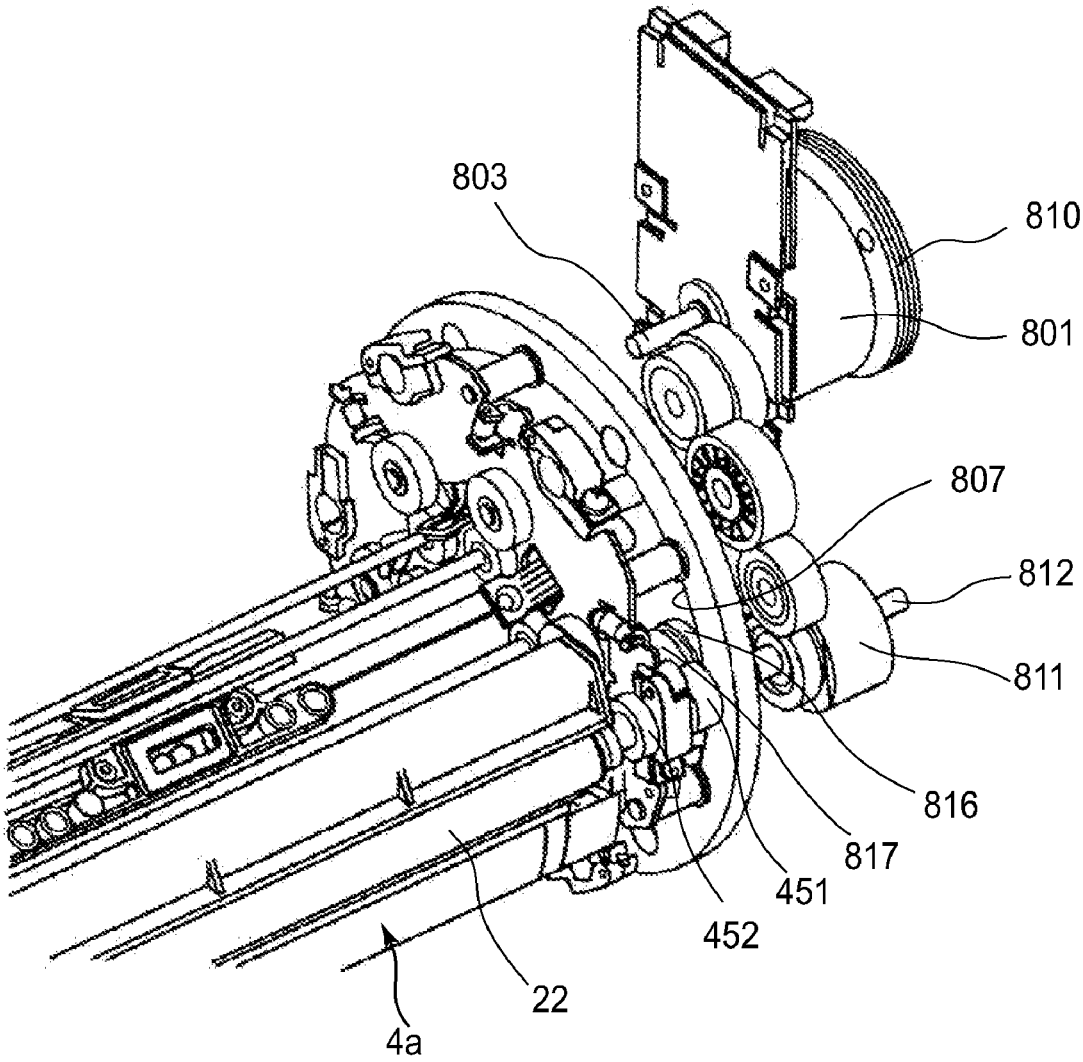
FIG. 10 is a perspective view illustrating the developing rotary and a developing drive input portion.
Figure 11:
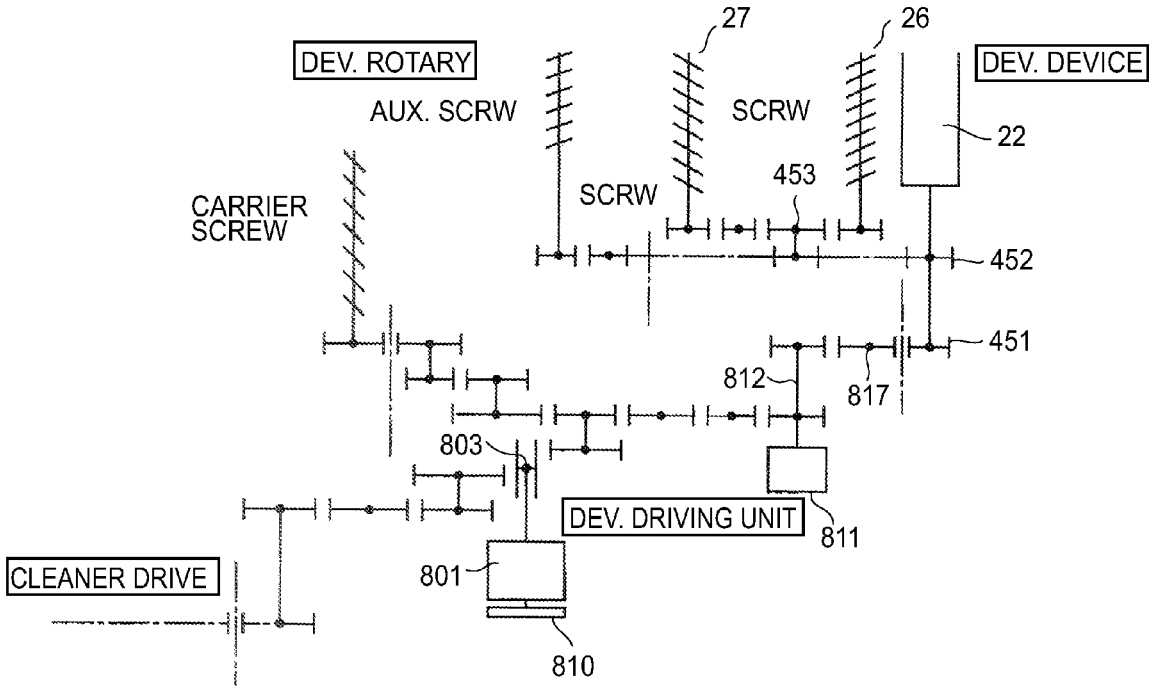
FIG. 11 is a schematic view illustrating a developing drive input portion.

Referring to FIGS. 10 and 11, the detailed description will be made as to a driving transmission path from the developing drive motor 801 in the developing drive unit to an inside of the developing device.

To a rear side of the motor rotor of the developing drive motor 801, a flywheel (inertia member) 810 is mounted co-axially with the motor shaft and with the developing drive motor gear 803, thus applying a moment of inertia.

The moment of inertia of the flywheel 810 is 3.8 kg·cm$^2$ which is sufficiently large as compared with rotation energy generated by load torque of the developing device and a difference between the speeds of the input gears upon the drive input to the developing device which will be described hereinafter.

If it is too large, there arises such problems that lifetime of the bearings of the motor decreases and that time required from the stop signal to the actual stop increases. From this standpoint, it is desirably small within the range effective to ease the impact upon the developing drive input (connection). The flywheel of this embodiment is determined on the basis of measured impact upon the drive input so as to satisfy such a condition resulting from the energy.

The driving train from the developing drive motor gear 803 to the developing device is as shown in FIGS. 10, 11, and the developing drive motor 801 rotationally drives a device other than the developing device in this embodiment. The driving of the developing device by the developing drive motor 801 has to be temporarily stopped upon switching of the developing device, and an unintentional drive connection to the developing device has to be avoided. For this reason, the drive control for the developing drive input gear 817 is carried out by an electromagnetic clutch 811, for example.

The developing drive input gear 817 functions to transmit the drive (driving force) to the sleeve gear 451 of the developing device. More particularly, the developing drive input gear 817 functions as a drive input gear for the sleeve gear 451 of the developing device, and the sleeve gear 451 of the developing device is a driven gear. The developing drive input gear 817 which is a drive input gear is driven by a developing drive motor 801 (driving source) which is disposed outside the developing rotary 40, more particularly, which is fixed in the main assembly side of the image forming apparatus. On the other hand, the sleeve gear 451 which is a driven gear is co-axially fixed on the developing sleeve 22 of the developing device 4*a*-4*f* which rotates together with the developing rotary 40. Therefore, the sleeve gear 451 transmits the drive to the developing sleeve 22.

Meshing engagement (backlash) between the developing drive input gear 817 and the sleeve gear 451 is assured by an abutment roller 816 mounted co-axially on the developing drive input gear 817 of the developing drive unit and an abutting portion 807 of the rotary gear 805 in the development rotary unit. Therefore, the developing drive input gear 817 and the abutment roller 816 are swingable about a clutch shaft 812 holding the development clutch 811 toward the center of the developing rotary.

Referring to FIG. 11, it is understood that in the developing device which receives the inputted drive at the sleeve gear 451, similarly to the sleeve gear 451, the fixed developing device gear 452 is rotated in the same rotational direction as the developing sleeve. By this, the drive is transmitted to stirring screws 26, 27 and so on in the developing device.

As shown in FIG. 11, the developing drive motor 801 simultaneously drives various elements such as the feeding screws and a cleaning unit in the developing rotary as well as the developing device.

As described hereinbefore, the input portion to the developing device which requires an ON-OFF control for the driving of the developing device necessitates a development clutch 811.

Here, the description will be made as to the mounting portion for the flywheel 810.

In the structure as shown in FIG. 11, a ratio of the rotational frequency of the developing drive motor and the rotational frequency of the development clutch shaft is 5:1, and largest possible rotation energy is desired with a smallest possible moment of inertia. When the flywheel 810 is mounted on the development clutch shaft 812 or at a position between the development clutch shaft 812 and the driving train of the developing device, the clutch 811 directly receives the moment of inertia of the flywheel 810 upon the clutch connecting action, with the possible result of remarkable decrease of the disk of the clutch 811.

For this reason, the flywheel 810 is directly mounted on the driving shaft of the developing drive motor 801.

However, depending on the amount of necessary rotation energy, the reduction ratio of the driving train and so on, it is preferable that the flywheel is mounted on an appropriate idler portion in the driving train upstream of the development clutch 811 and downstream of the developing drive motor 801. In this embodiment, however, the structure is as described above.

Figure 12:
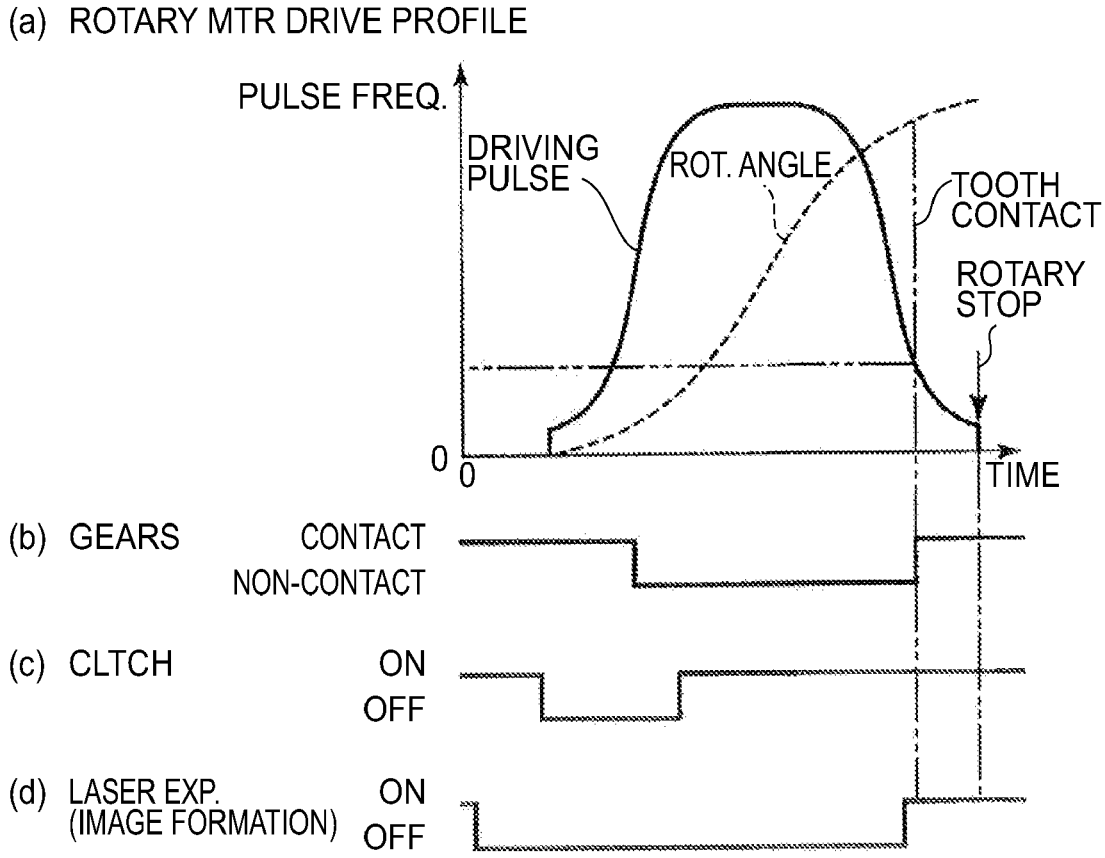
FIG. 12 shows a rotary motor driving profile, a gear relation, states of a clutch, and a timing chart of the laser exposure.

Referring to FIG. 12 which is a timing chart, the driving of the developing rotary 40 will be described.

In FIG. 12, (a), the solid line is a driving profile of the rotary driving motor 802. The ordinate represents driving pulse (frequency) of the stepping motor, and the abscissa represents time. The driving pulse is considered as being proportional to the rotational speed.

The broken line is an integrated rotation (movement) angle of the rotary from the start (=0°) of rotation of the developing rotary 40 to the end (=0°) of rotation (stop) thereof.

As described above, the developing rotary 40 is driven by the stepping motor 802. Therefore, as shown in FIG. 12, the stepping motor 802 is driven under the control of a driving curve (table) exclusively therefor which is symmetrical parabolic driving pulse setting for the purpose of easing the impact upon acceleration and deceleration and for the purpose of avoiding the torque variation due to the load torque and the moment of inertia.

As shown in FIG. 12, the ON timing of the development clutch 811 is quite before the contact between the developing drive input gear 817 and the sleeve gear 451.

This is determined on the basis of results of experiments which will be described hereinafter. The developing drive input gear 817 which has already started its rotation is brought into engagement with a sleeve gear which does not rotate by itself but which revolves by the rotation (revolution or circulation) of the rotary 40. By doing so, the impact upon the start of rotation of the driving train for the sleeve of the developing device which will be described hereinafter is small.

The driving pulse at the time when the developing drive input gear 817 and the developing sleeve gear 451 are brought into contact to each other at the tooth top portion, is read from FIG. 12, and the rotational speed of the rotary can be determined at this time. Then, it is understood that developing drive input gear 817 is rotating at a speed of approx. 70 rpm.

In FIG. 12, the OFF timing of the development clutch seems to be fixed. What is illustrated in the Figure is under the condition that image is formed in a maximum image range. In the case of a shorter image range or a shorter sheet size, the development clutch 811 is controlled to become OFF a predetermined time before the shown timing, the predetermined time corresponding the shortness of the image range. By doing so, deterioration of the developer caused by unnecessary rotation of the developing device can be avoided.

The ON timing of the development clutch 811 is all fixed. More particularly, the timing is immediately after the separation between the developing drive input gear 817 and the developing sleeve gear 451.

It is selected as the earliest timing that sleeve gear of the developing device (after the developing operation) is not rotated before start of rotation of the rotary, in consideration of the fact that short time is required for the establishment of connection of the development clutch 811.

As regards the laser exposure shown in FIG. 12, (d), in the image forming apparatus of this embodiment shown in FIG. 1, it is understood that exposure operation has already been completed prior to stop of the developing rotary 40, from the exposure position, the developing position and the peripheral speed of the photosensitive drum.

This is accomplished by properly selecting the circumferential length of the intermediary transfer belt 5, the peripheral speed of the photosensitive drum 1 and so on. However, when the throughput of the image forming apparatus is to be enhanced or when the switching of the developing rotary 40 is performed without impact at the time of stoppage, the stop timing of the developing rotary 40 is after the exposure operation, in many cases.

Therefore, the consideration has to be paid to the vibration in order to avoid adverse affect to the image exposure operation as in this embodiment.

Figure 13:
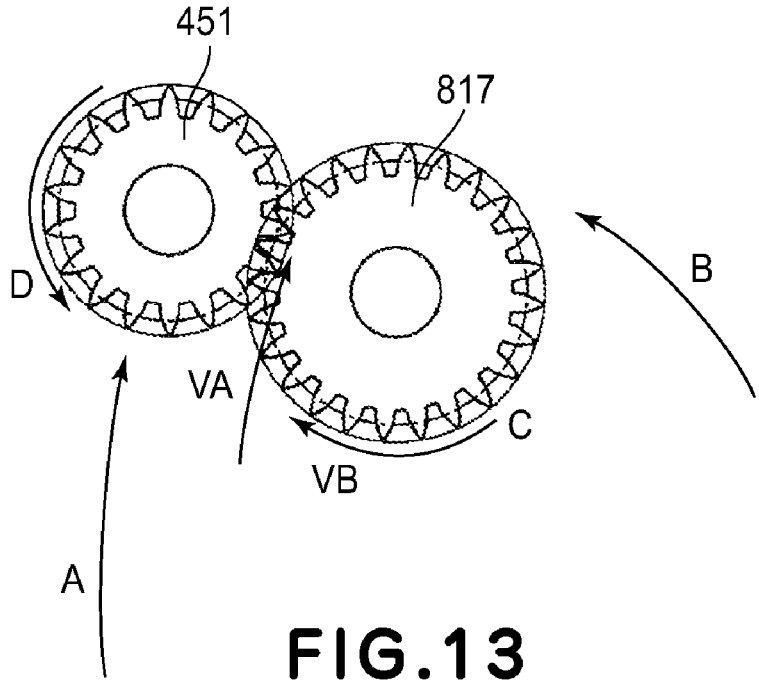
FIG. 13 is a detailed illustration of an engagement portion between a developing drive input gear and a sleeve gear.

Referring to FIG. 13, the description will be made as to a relation between the speeds of the developing drive input gear 817 and the sleeve gear 451.

FIG. 13 illustrates the developing devices 4*a*-4*f* and developing rotary 40 as seen from the developing drive unit, that is, from the developing drive motor 801 side in FIG. 9.

As shown in FIG. 13, the sleeve gear 451 revolves or circulates in the direction indicated by an arrow A, and receives the rotational drive from the developing drive input gear 817 in the direction D.

The developing drive input gear 817 is swingable in the direction B, and it is in a waiting position for waiting the sleeve gear 451 while rotating at approx. 380 rpm in the direction C.

The revolution or circulation speed VA of the engaging sides of the tooth top portions of the sleeve gear 451 and the developing drive input gear 817 is determined by the rotary diameter, the gear diameters and the revolution speed (approx. 70 rpm) at the instance of engagement described hereinbefore. The revolution speed VA is a moving speed, at the time of revolution, of the addendum circle portion closest to the center of rotation of the rotary one, on the addendum circle of the sleeve gear 451 moving by the rotation of the rotary. In this embodiment, it is approx. 460 mm/sec.

Similarly, the rotational speed (peripheral speed) VB of the addendum circle of the developing drive input gear 817 is determined by the input rotational frequency and the number of teeth and the outer diameter thereof, and it is approx. 480 mm/sec in this embodiment.

The peripheral speed of the developing drive input gear 817 is determined so as to provide a peripheral speed of the developing sleeve 22 which is in the range of 1.70-1.80 times the peripheral speed of the photosensitive drum 1. In addition, the peripheral speed of the developing drive input gear 817 is determined by the number of teeth of the drive input gear and the process condition (mainly developing condition), that is, the codirectional rotation relative to the rotation of the photosensitive drum is preferable.

In this embodiment, VA/VB=0.958 as will be understood.

By such a setting, when the drive connection is being established from the developing drive input gear 817 to the sleeve gear 451, the tooth top portion of the sleeve gear 451 which is not rotated by itself actually moves substantially at the same speed as the tooth top portion of the input gear 817. Therefore, the establishment of the drive connection is very smooth.

The smoothness of the establishment of the drive connection significantly reduces generation of the vibration due to the load variation and the speed variation upon developing device drive input, when the drive is transmitted to the rest developing device. As a result, the image exposure process operation can be performed without external disturbance such as vibrations.

The absence of vibration upon the developing drive input means that rotation of the developing sleeve is always stabilized, and therefore, very good developing processes operation is carried out.

As regards the ratio VA/VB, it may vary in the range of approx. ±0.3 due to various positional tolerances in manufacturing and/or the variation in the control timing.

Therefore, when VA/VB exceeds 1, for example, a further force is produced in the direction of rotating the developing drive input gear 817 (overriding).

In such a state, there is a liability that large reaction force is produced in the developing device side, that is, the rotary side. Therefore, it is required that one-way clutch or the like is provided in the gear train of the developing drive input side, for example, so as to prevent the overriding. This embodiment is preferable in that even if the tolerance or the like varies, then VA/VB≦1 is always satisfied.

For example, the condition VA/VB≦1.00 means that developing drive input side is faster always, by which the overriding in which the developing drive side is rotated by the rotatable member. By this, the use of one-way clutch as the countermeasurement against the overriding is not necessitated, while assuring the stable drive input.

Figure 14:
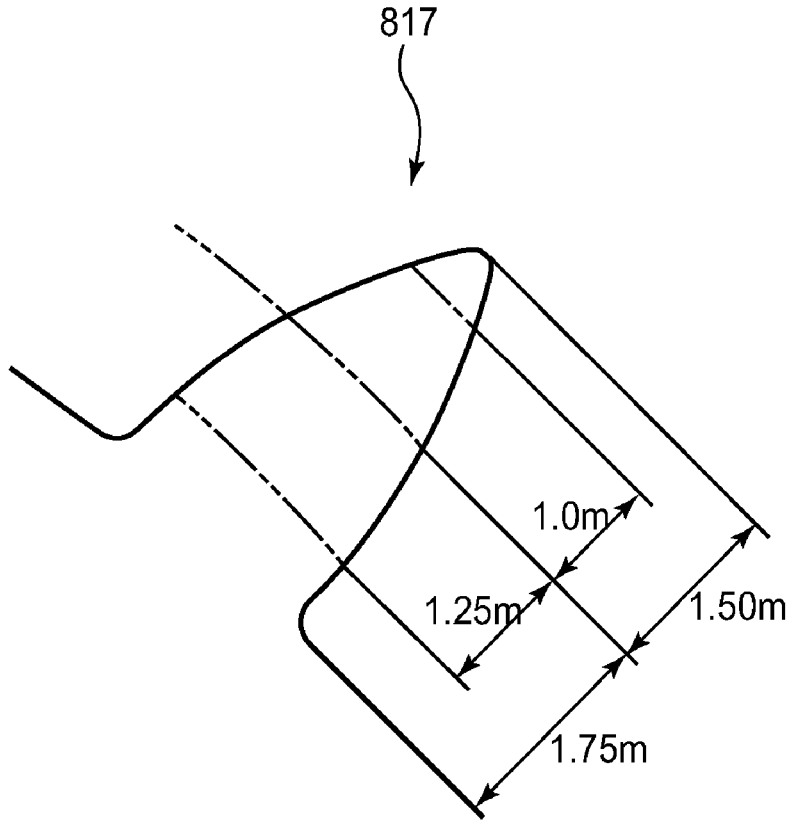
FIG. 14 is a detailed illustration of tooth top configuration of a gear.

In addition, as shown in FIG. 14, the tooth top portion of the drive input gear 817 in this embodiment has a high tooth gear configuration with which the addendum circle circumference portion of the gear is minimized.

This is because there is a liability that at the instance of the establishment of the driving connection as shown in FIG. 13, the tooth top portions of the gears collide to each other, and they rebound to be away from each other, and then, they again contact each other, with the result of delay in the meshing engagement.

For example, when the tooth top portions of the gears collide to each other, the drive input gear 817 instantaneously rebounds in the direction opposite to the direction B in FIG. 13.

When the gear 817 returns to the engagement position relative to the gear 451, the revolution or circulation speed of the developing rotary 40 significantly reduces as compared with the initial stage of the engagement, and more particularly, in the case of the driving table of this embodiment, the speed lowers to approx. 10-20 rpm.

Therefore, the VA/VB at this time is as low as approx. 0.15-0.25. This means that drive is applied to the developing device with the state of very large speed difference, so that impact upon the developing drive input is large correspondingly.

For this reason, the high tooth gear configuration shown in FIG. 14 is employed in order to minimize the tooth top portion abutment. The specific shape of the high tooth gear is not limited to the gear 817, but may be employed in the gear 451, or both of the gears 817, 451 may employ the high tooth gear configuration.

From that foregoing conditions and the result of experiments, the length of the arcuate portion of the addendum circle is 0-0.4 mm in this embodiment. If the length of the arcuation is not more than 0.4 mm, the tolerable range of probability of the tooth top portion abutment (approx. 1/1000) decreases. Therefore, in the high teeth of this embodiment, the height of the tooth top is 1.5 m (module), and the height of the addendum is 1.75 m (module).

The similar effect can be provided by another method, for example by employing a profile shifted gear or by beveling the circumference of the addendum circle portions. One skilled in the art can properly make selection on the basis of the intended lifetime of the gear, the usable space, the speeds upon the contact of the end portions of the gears and so on.

In this embodiment, the timing of the contact tooth top portions of the gears is made as early as possible to provide the desired value of the VA/VB by employing the high tooth gear configuration.

The upper limit value of the VA/VB is as described above. The lower limit value will be described.

As described in the foregoing, when the tooth top portions collide, the revolution speed of the rotary upon the subsequent gear engagement is significantly low. However, if the VA/VB at the time of the first abutment is low, namely, the revolution speed of the rotary is low, the timing of the next engagement is very close to zero upon occurrence of teeth top abutment which is very rare, though.

As regards the first engagement, if the speed difference is large, the flywheel 810 is not very effective, or the size of the flywheel 810 has to be increased.

If the size is increased, the rigidity of the developing drive unit and the torque of the developing drive motor 801 would have to be excessively high.

Accordingly, the above-described settings are desirable. When the variation is taken into account, the VA/VB may vary to approx. 0.93-0.99 even in this embodiment.

However, a large number of experiments (measurement of vibration) have revealed that value is within the tolerable range.

The lower limit value of VA/VB is 0.90, taking into account the moment of inertia of the flywheel 810 and the revolution speed of the rotary 40 upon the second engagement.

Thus, VA/VB is preferably not less than 0.90 and not more than 1.00. With such structures, the drive can be inputted to the developing device under the state that drive inputting speed to the developing device substantially balances with the revolution speed of the developing rotary. Therefore, the shock which may be caused by the speed difference between the driving side and the driven side can be substantially eliminated.

Thus, the impact which may be caused upon the start of input of the drive to the developing device can be reduced, and the deterioration of the image and the malfunction of the image forming apparatus which may arise therefrom can be prevented.

The experiments have been carried out in which an optical sensor is set at the laser exposure portion of the photosensitive drum 1 to detect a positional deviation of the laser exposure.

The amount of positional deviation of the laser exposure is directly related with the image disturbance, and if it is larger than approx. 3 μm, a dark and light pattern (non-uniformity) is remarkable on the output paper. Therefore, the conditions are determined so that it is not more than 3 μm. The results are shown in FIG. 15.

Because, however, the actual values involve other external disturbances, the shown waveform is provided after such external disturbances are removed.

Figure 15:
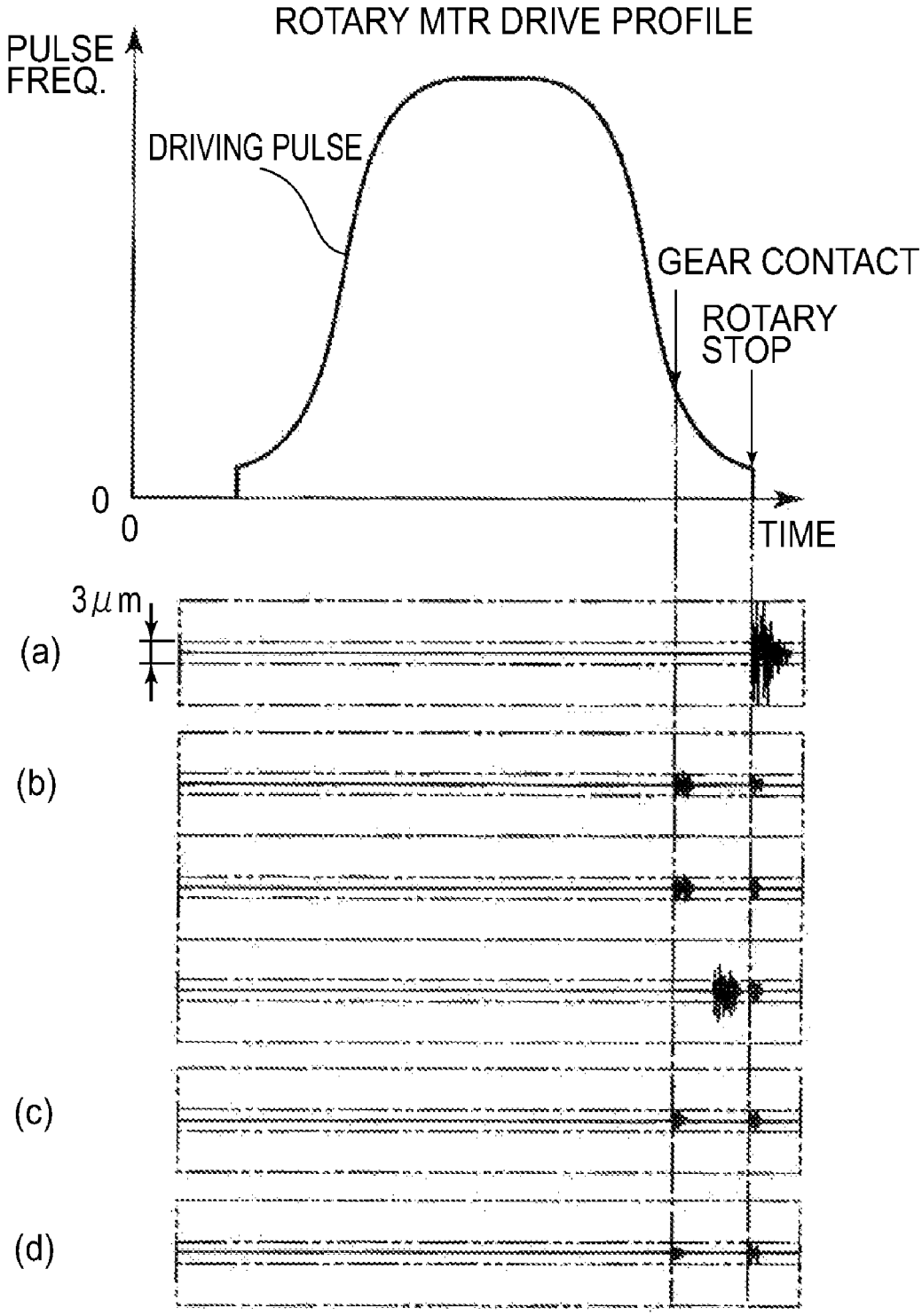
FIG. 15 shows a result of experiments.

(A) in FIG. 15, (a) shows the results of the case (reference case) in which the ON timing of the development clutch is the same as the stop timing of the rotary.

(B) in FIG. 15, (b) shows the results of the cases in which the ON timing of the development clutch is the same as in this embodiment wherein VA/VB is 0.8.

(C) in FIG. 15, (c) shows the results of the case wherein the gear tooth top configuration is high teeth, and VA/VB is the same as with the present invention.

(D) in FIG. 15, (d) shows the results of the case wherein a flywheel is mounted to the developing drive motor.

As will be understood from the Figure, the case (A) is not preferable because the vibration is generated simultaneously.

In the case (B), the impact is diluted, and the effect of VA/VB=0.8 is recognized, but the waveform of the bottom one of the case (B) shows a waveform which exhibits a delay of engagement (abutment of the tooth top portions).

The abutment occurred at a frequency of ⅛.

It is understood that if VA/AB is approx. 0.8, the exposure positional deviation may exceeds 3 μm.

In the case (C), the delay of the engagement is not recognized in 100 times of measurements, and in addition, in the case (D), the impact upon the engagement is sufficiently eased.

The effects of cases (C) and (D) may seem to be very significant, but the effects of the flywheel include prevention of vibration in the engagement of the gears, suppression of load variation in another part and so on in addition to the avoidance of the influential impact. If such a situation is taken into account, the effects of the present invention are significant.

As described in the foregoing, by using, as at least one of the driven gear and the drive input gear, a gear having an arcuation length of the addendum circle in the circumferential direction is 0-0.4 mm, the teeth top abutment can be avoided. In addition, the timing of the gear engagement (connection) can be made constant.

Thus, the driving connection is always assured with substantially no speed difference between VA and VB, so that stabilized operation and stabilized image can be assured always.

The provision of the flywheel (inertia member) applying the moment of inertia between the driving source for driving the drive input gear and the drive input gear is advantageous in that: The impact arising from the speed difference attributable to the difference between VA and VB can be sufficiency accommodated by the inertia in the drive input side. In addition, a small variation in the speed difference attributable to the variation in the drive timing and/or to the manufacturing tolerances of parts can be accommodated.

From the foregoing, it is understood that impact arising upon stop of the developing rotary and/or upon the drive input to the developing device can be eased effectively.

In the foregoing, the description has been made as to an image forming apparatus of intermediary transfer type. However, the present invention is applicable to a known feeding belt type image forming apparatus wherein a feeding belt for carrying a recording paper P is employed in place of the intermediary transfer belt 5, and the toner images of different colors are overlaid on the recording paper P.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 264490/2005 filed Sep. 12, 2005 which is hereby incorporated by reference.

What is claimed is:

1. An image forming apparatus comprising:

an image bearing member on which an electrostatic image is formed by an exposure device;

a rotatable member;

a developing device carried on said rotatable member and movable, by rotation of said rotatable member, to a developing position where said developing device is opposed to said image bearing member;

a driven gear which is provided in said developing device and which receives a driving force for operating said developing device;

a driving gear, provided in a main assembly of the image forming apparatus, for driving engagement with said driven gear of said developing device which is located at the developing position, wherein said driving gear, when said developing device is moving toward the developing position, is driven such that moving direction thereof is the same as a moving direction of said driven gear at an engagement portion with said driven gear, wherein upon driving engagement between said driven gear and said driving gear, a peripheral speed VA of said driven gear which is being moved by said rotatable member on an addendum circle thereof at said engagement portion and a peripheral speed VB of said driving gear on an addendum circle thereof satisfy:

$$0.9 \leqq VA/VB \leqq 1.0;$$

an inertia member, disposed in a driving train between said driving source and said driving gear, for providing said driving train with a moment of inertia; and a driving engagement member, provided in said driving train, for ON/OFF control of transmission of the driving force from said driving source to said driving gear, wherein said inertia member is disposed in a driving train upstream of a driving shaft portion supporting said driving engagement member with respect to a drive transmission path, and wherein said driving engagement member starts drive transmission before contact between the addendum circle of said driving gear and the addendum circle of said driven gear, and when the addendum circle of said driving gear and the addendum circle of said driven gear are contacted, said driving gear is rotating at a predetermined rotational frequency.

* * * * *